US007445542B2

(12) United States Patent
Delle Vedove

(10) Patent No.: US 7,445,542 B2
(45) Date of Patent: Nov. 4, 2008

(54) MACHINE FOR FINISHING AN OBJECT SUCH AS A PROFILED ELEMENT, A PANEL, OR SUCHLIKE

(75) Inventor: Gaetano Delle Vedove, Pordenone (IT)

(73) Assignee: Delle Vedove Levigatrici SpA, Pordenone (IT)

( * ) Notice: Subject to any disclaimer, the term of this patent is extended or adjusted under 35 U.S.C. 154(b) by 0 days.

(21) Appl. No.: 11/569,203

(22) PCT Filed: Oct. 4, 2004

(86) PCT No.: PCT/IB2004/003215

§ 371 (c)(1),
(2), (4) Date: Nov. 16, 2006

(87) PCT Pub. No.: WO2005/110677

PCT Pub. Date: Nov. 24, 2005

(65) Prior Publication Data

US 2007/0232205 A1 Oct. 4, 2007

(30) Foreign Application Priority Data

May 17, 2004 (IT) ..... UD2004A0101

(51) Int. Cl.
*B24B 7/00* (2006.01)
*B24B 9/00* (2006.01)

(52) U.S. Cl. ..... 451/65; 451/67; 451/182; 451/451

(58) Field of Classification Search ..... 451/65, 451/66, 67, 68, 69, 70, 71, 182, 184, 296, 451/297, 299, 300, 301, 311, 332, 336, 451
See application file for complete search history.

(56) References Cited

U.S. PATENT DOCUMENTS

| | | | | |
|---|---|---|---|---|
| 4,178,721 | A * | 12/1979 | Evans | 451/301 |
| 4,396,836 | A * | 8/1983 | Vitaliani et al. | 250/223 R |
| 4,818,570 | A * | 4/1989 | Milles | 427/273 |
| 4,938,111 | A * | 7/1990 | Masse | 83/425.3 |
| 5,005,318 | A * | 4/1991 | Shafir | 451/70 |
| 5,060,423 | A * | 10/1991 | Klotz | 451/5 |
| 5,085,008 | A * | 2/1992 | Jennings et al. | 451/184 |
| 5,531,636 | A * | 7/1996 | Bissen | 451/130 |
| 5,733,180 | A * | 3/1998 | Kilde | 451/65 |
| 6,375,556 | B1 * | 4/2002 | Wenger | 451/331 |
| 6,572,459 | B2 * | 6/2003 | Bonachera | 451/172 |

(Continued)

FOREIGN PATENT DOCUMENTS

DE 19920950 11/2000

(Continued)

*Primary Examiner*—Timothy V Eley
(74) *Attorney, Agent, or Firm*—Gottlieb, Rackman & Reisman, P.C.

(57) ABSTRACT

A machine for finishing an object comprising feed members to feed the object along a reference plane (P1), and at least a work station provided with a tool which contacts the object in a work zone (Z) near the reference plane (P1). The machine comprises two lateral supporting walls arranged substantially orthogonal both to the reference plane (P1) and also to the median plane (P2), which support the work station laterally, in order to define with the work station a modular structure able to be selectively associated with other modular structures along the direction of feed of the object.

16 Claims, 6 Drawing Sheets

U.S. PATENT DOCUMENTS

| | | | | |
|---|---|---|---|---|
| 6,722,960 | B2 * | 4/2004 | Brooks | 451/65 |
| 6,736,127 | B2 * | 5/2004 | Steckling | 125/23.01 |
| 6,743,077 | B2 * | 6/2004 | Busenhart | 451/40 |
| 6,767,273 | B1 * | 7/2004 | Coverdale et al. | 451/5 |

FOREIGN PATENT DOCUMENTS

| | | |
|---|---|---|
| WO | WO03/099461 | 12/2003 |

* cited by examiner 420
55
55
55
55
53
53
53
54
52

20
39
39
39
36
37
35
36

120
40
41

MACHINE FOR FINISHING AN OBJECT SUCH AS A PROFILED ELEMENT, A PANEL, OR SUCHLIKE

FIELD OF THE INVENTION

The present invention concerns a machine for finishing an object such as a profiled element, a panel, or suchlike, made of any material such as wood, metal, plastic or other. To be more exact, the machine according to the invention comprises a plurality of work stations arranged in line, which can be, for example, for smoothing, painting, cutting, covering or other operations.

BACKGROUND OF THE INVENTION

A machine is known for finishing an object, such as a wooden profiled element, or suchlike, which comprises feed means to feed the object to be finished along a reference plane.

The machine also comprises one or more work stations mounted in line on the base, along the reference plane, at a determinate distance from each other, in order to finish longitudinally the outer surfaces of the object.

Generally, part of the work stations is able to smooth the outer surfaces of the object, and comprises a supporting frame, or operative assembly, inside which an abrasive belt is arranged or one or more abrasive grinding wheels driven by relative motors.

Each supporting frame, or operative assembly, can be oriented, as desired, according to the position of the surface of the object on which the abrasive belt has to exert its smoothing action. To be more exact, the supporting frame, or operative assembly, can be positioned as desired between a first operating position substantially vertical with respect to the reference plane, and a second operating position inclined with respect to the first operating position by an angle of less than 180°.

To ensure that all the outer surfaces of the object are smoothed, the abrasive belts are able to contact alternately the upper, lower, left and right surfaces of the object. In this way, the relative supporting frames are thus arranged alternately above, below, left and right with respect to the base.

This alternated arrangement of the supporting frames however, entails a lateral bulk that is irregular with respect to the base, causing problems of safety, in order to limit the risk of accidents.

It is therefore difficult to guarantee the safety of the workers, especially to prevent them from accessing the zone where the abrasive belt, or abrasive grinding wheel, contacts the object, and to prevent the accidental escape from said zone of chip or other waste materials.

It is also difficult to guarantee the safety of the workers, to prevent their access to the zone where the objects pass from one work station to another, guided by profiles with guide wheels and pressed on the feed means by other pressure wheels.

The other work stations provided on finishing machines are chosen each time according to the type of finishing that has to be performed on the object and are, for example, painting, covering, cutting stations, etc.

On the one hand, this choice allows wide flexibility in setting up the machine, but on the other hand it entails, on each occasion, a specific design of the base according to the type of work stations that have to be mounted, with a consequent increase in production times and costs, and also in the management of the spare parts in store.

Another disadvantage is that, on each occasion, specific connection members have to be provided, which allow the various feed means to be mounted on the base.

From WO-A-03/099461, of the same applicant of the present patent application, it is known an apparatus and a method for painting objects, wherein the apparatus comprises a painting head for painting the objects, a movement member to move the objects through the painting head, working members arranged upstream and in line with the painting head to perform a treatment on the objects before they are introduced into the painting head, and a drying member arranged downstream and in line with the painting head in order to dry the objects after they have been painted.

Moreover, from DE-A-19 920 950 it is known a machining device which has a transport chain between input and output stations carrying work-pieces, as panels for furniture, to various processing stations for edge profiling, glue application, and capping, and a frame carrying the stations and transport chain. Each processing station consists of a segment and at least one module. The segment contains running track sections for the transport chain and a base bearer as a frame section for connection to base bearers of adjacent segments. However, this known machine is solely useful for working one single edge of the panel to be worked at a time; in fact each panel can be inserted in the machine from only one side thereof.

One purpose of the present invention is to achieve a finishing machine for a profiled element, a panel or suchlike, which will prevent an operator from directly accessing the zone where the tools of the various work stations are in action, or the adjacent transport zones where the object passes from one work station to another, and prevent waste materials or other elements present, from escaping accidentally from said zones.

Another purpose of the present invention is to achieve a finishing machine which does not require, on each occasion, a specific design of the components, according to the finishing operations to be performed, or the type of object to be worked.

Another purpose of the present invention is to achieve a finishing machine which can provide any type of feed means for the objects, without requiring specific connection members on each occasion.

Applicant has devised, tested and embodied the present invention to overcome the shortcomings of the state of the art and to obtain these and other purposes and advantages.

SUMMARY OF THE INVENTION

The present invention is set forth and characterized in the main claim, while the dependent claims describe other characteristics of the present invention or variants to the main inventive idea.

In accordance with the above purposes, a machine according to the present invention for finishing an object comprises feed means to feed the object along a reference plane, and at least a work station provided with at least a tool, which is able to contact the object in a work zone, near the reference plane, following the profile thereof.

The work station is able to be positioned in a desired plurality of work positions comprised between a first position, wherein it lies on a median plane substantially perpendicular to the reference plane, and a second position, wherein it is substantially inclined by an angle of less than 180° with respect to the first position, thus defining a circular work sector.

According to a characteristic feature of the present invention, the machine comprises two lateral supporting walls, arranged transverse both to the reference plane and also to the median plane, distanced from each other and able to support the work station laterally, so as to define with the latter a modular structure able to be selectively associated with other, similar modular structures, along the direction of feed of the object.

In this way, it is therefore possible to achieve a complex finishing machine simply by combining together in line a plurality of modular structures.

Moreover, the modular nature of the machine according to the present invention allows to reduce to a minimum the costs and times of preparation and assembly, and also the costs of managing the spare parts in the store and of maintenance.

According to a variant, the machine also comprises a protection element arranged on the side opposite the circular work sector, with respect to the median plane, and able to cover at least temporarily and partly the work zone and the transit or transport zone where the object is transported, by the feed means, from one work station to the other.

In this way, an operator is prevented from directly accessing the transport zone and the work zone, thus limiting the risk of accidents. Moreover, the protection element prevents the waste materials, or other elements present inside the work zone, from accidentally escaping therefrom.

According to another variant, the protection element is mounted able to be positioned with respect to the lateral supporting walls; it can thus be positioned between a position of protection, wherein it prevents access to the work zone and the transport zone, and an equipping position, wherein it allows access to the work zone and the transport zone.

According to another variant, the two lateral supporting walls comprise coordinated through apertures, able to allow the feed means to be positioned inside them.

BRIEF DESCRIPTION OF THE DRAWINGS

These and other characteristics of the present invention will become apparent from the following description of a preferential form of embodiment, given as a non-restrictive example, with reference to the attached drawings wherein.

DETAILED DESCRIPTION OF A PREFERENTIAL FORM OF EMBODIMENT

Figure 1:
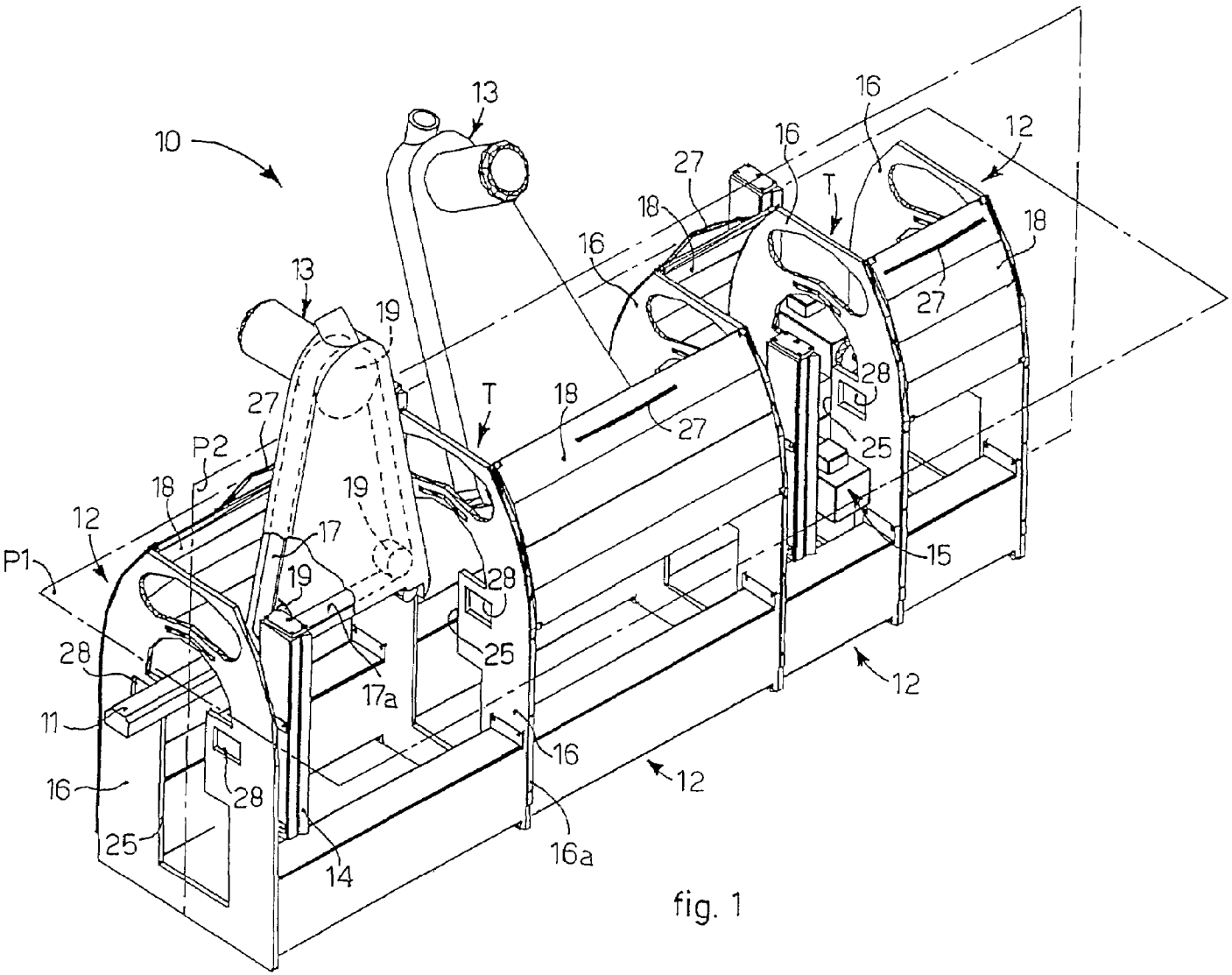
FIG. 1 is a schematic three-dimensional view of a machine for finishing an object according to the present invention.

With reference to FIG. 1, a machine 10 for finishing an object 11 according to the present invention in this case consists substantially of four modules 12 arranged in line, each one comprising a specific work station.

In this case, the first two modules 12 comprise respective work stations provided with belt-type smoothing machines 13, while the last two modules 12 comprise work stations provided with further finishing members 15, not shown in detail and of a substantially known type, such as for example smoothing members with grinding wheels, painting members, cutting members, covering members or other.

For simplicity of description, the object 11 finished by the machine 10 according to the invention will be indicated hereafter as a profiled element 11, but this does not excludes that the object may be for example a lath of a frame, a panel or suchlike, made of any material whatsoever, like wood, metal, plastic or other.

The machine 10 according to the invention also comprises a feed member, specifically shown in some of its variant embodiments in FIGS. 5, 6, 7, 8 and 9, and indicated respectively by the reference numbers 20, 120, 220, 320 and 420. The feed member 20, 120, 220, 320 and 420 is able to automatically feed the profiled element 11 through the various modules 12 along a reference plane P1, in this case, substantially horizontal.

Each module 12 (FIGS. 1, 2, 3 and 4) comprises two lateral supporting walls 16, substantially vertical, parallel with each other and substantially orthogonal to the reference plane P1, which are able to support laterally the respective belt-type smoothing machine 13, or other work station 15.

The belt-type smoothing machine 13 is arranged above the reference plane P1 and is of the type provided with at least an abrasive belt 17 wound annularly around three pulleys 19, of which one is motorized, so that at least one segment 17*a* thereof is substantially tensed and rectilinear, so as to be arranged in contact with an outer surface of the profiled element 11 in a work zone Z, near the reference plane P1, and thus perform the smoothing operation.

The belt-type smoothing machine 13 can also be rotated into a plurality of work positions comprised between a first position wherein it lies on a median plane P2 substantially perpendicular to the reference plane P1, and a second position wherein it is substantially inclined, in this case, by an angle of a little over 90°, with respect to its first position, thus defining a circular work sector S, substantially opposite the work zone Z, with respect to the median plane P2.

To be more exact, the belt-type smoothing machine 13 is pivoted on a positioning column 14 mounted on the inner part of one or of both the lateral supporting walls 16.

Moreover, the lateral supporting walls 16 each have a circular eyelet 21 able to allow the positioning, also angled as desired, of a pressure member, not shown in the drawings, able to guide and keep the profiled element 11 in a desired reference position during the working steps.

According to a variant not shown here, the eyelet 21 can be rectilinear, or can have any other development, according to the type of profiled element 11 to be worked, or the type of work to be done.

Each lateral supporting wall 16 also has two positioning holes 28, able to house inside them specific guide means, of a substantially known type and not shown here, to keep the profiled element 11 guided laterally in a transport zone T, wherein the latter is transported from one module 12 to another. The guide means can be for example: guide bars, squares, sliders with wheels or other.

According to the present invention, the machine 10 also comprises a protection element 18, 118, 218, with a shape mating at least with the upper part of the profile of the lateral supporting walls 16, and arranged in connection with the latter on the side opposite the circular sector S with respect to the median plane P2, so as to substantially cover the work zone Z and the transport zone T, at least during the operative steps of the machine 10.

Figure 2:
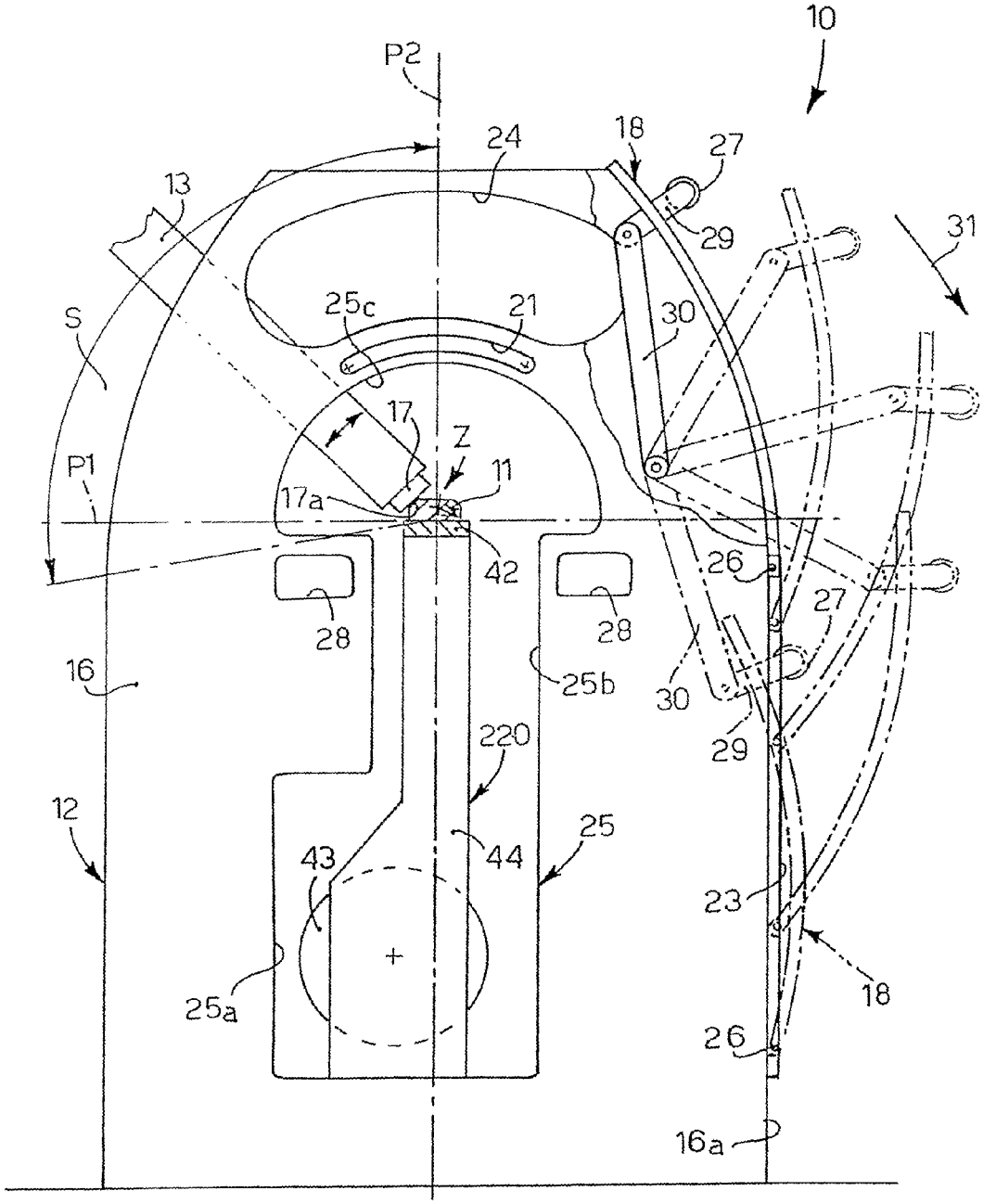
FIG. 2 is a schematic side view of the machine in FIG. 1.

In the embodiment shown in FIG. 2, the protection element 18 is advantageously mounted sliding with respect to the two lateral supporting walls 16, so that it can be selectively positioned between a protection position, shown in a continuous line in FIG. 1, wherein it prevents access to the work zone Z and the transport zone T, and an equipping position, wherein it allows access to said work zone Z and transport zone T, for example to perform equipping operations or maintenance or other.

The sliding assembly of the protection element 18 is achieved by means of a pair of sliding wheels 26 (FIG. 2) mounted rotatable thereon, on the lower part of its lateral edges 18*a*, and able to slide inside mating sliding guides 23, made on the inner surface of each lateral supporting wall 16, or the surface facing towards the belt-type smoothing machine 13, or the other work station 15. To be more exact, each sliding guide 23 is made in proximity with one edge 16*a* of the respective lateral supporting wall 16, opposite the circular work sector S.

Moreover, the protection element 18 comprises, on the outer side, a gripping handle 27 connected laterally to two bars 29, of which only one is visible in the figures, arranged through the protection element 18 and pivoted, on the inner side of the latter, to a guide lever 30, which is in turn pivoted to the lateral supporting walls 16.

In this way, as shown by the line of dashes in FIG. 2, starting from the protection position, a manual traction of the gripping handle 27 in the direction of the arrow 31 entails the passage of the protection element 18 to its equipping position.

Figure 3:
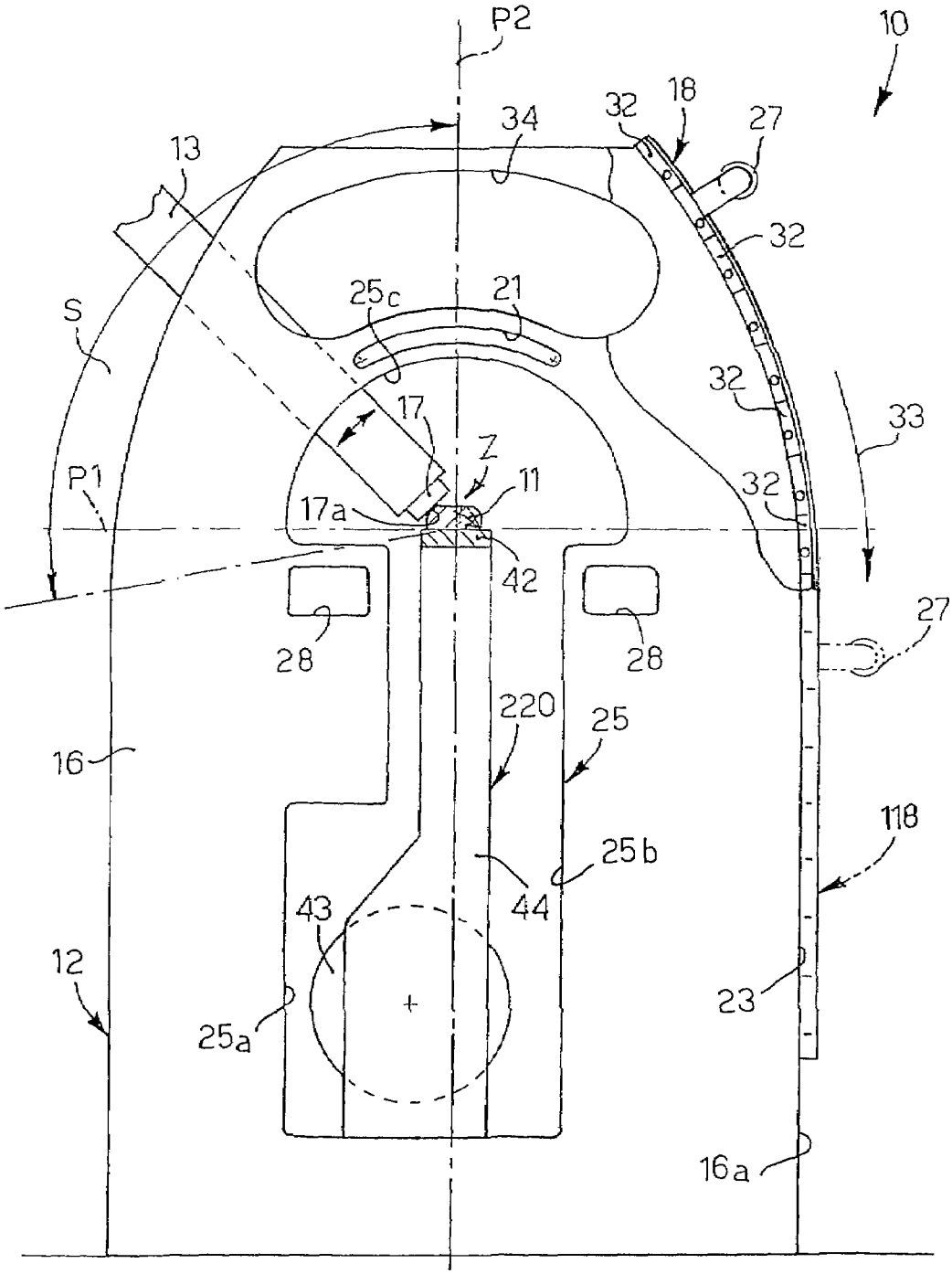
FIG. 3 shows a first variant of FIG. 2.

According to the embodiment shown in FIG. 3, the protection element, indicated by the reference number 118, consists of a plurality of sections 32 articulated to each other and able to slide inside the sliding guides 23, so that by acting in the direction of the arrow 33, the protection element 118 slides from its protection position, shown in a continuous line, to its equipping position, shown by a line of dashes.

Figure 4:
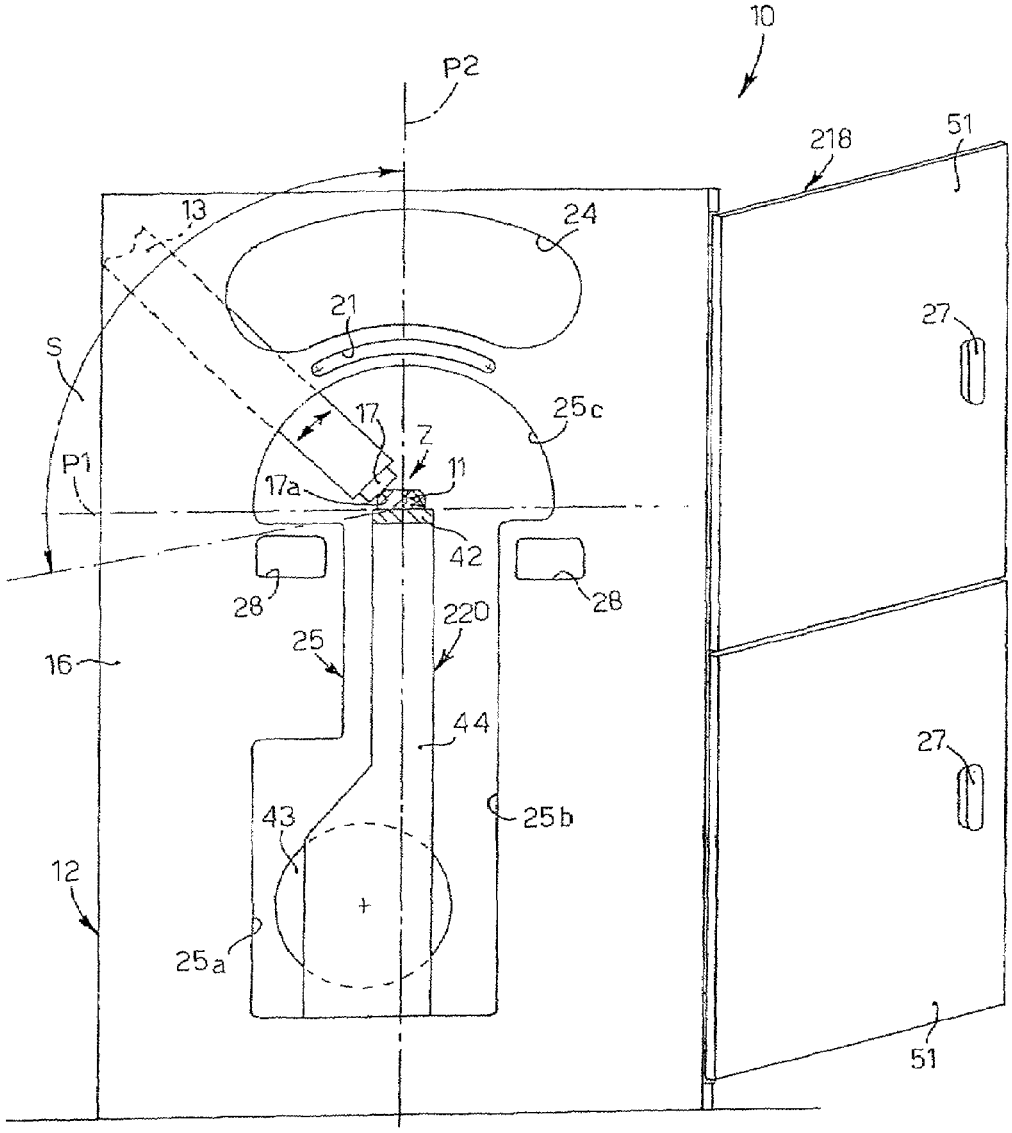
FIG. 4 shows a second variant of FIG. 2.

In the embodiment shown in FIG. 4, the protection element 218 consists of two doors 51, shown here in their equipping position, which are individually and selectively able to be opened by means of the handles 27, in order to allow access to the work zone Z and the transport zone T. In this embodiment the lateral supporting walls 16 have a square shape in the upper part, so as to simplify the positioning and construction of the doors 51.

In all the embodiments described above, the work zone Z and the transport zone T are in any case selectively isolated and, in practice, access to said work zone Z and transport zone T for the operator is prevented, at least during the operating steps of the machine 10. Moreover, this isolation prevents waste materials or other remnants from escaping from said work zone Z, and possibly from the transport zone T, and accidentally hitting the operator or other adjacent structures.

Advantageously, safety sensors are associated with the sliding guides 23, in those embodiments where they are provided; the safety sensors are able to prevent the functioning of the whole machine 10 when at least one of the protection elements is not in its protection position.

Each of the two lateral supporting walls 16 also comprises a lightening hole 24 and a through aperture 25, the latter for positioning the respective feed member 20, 120, 220, 320, 420.

The lightening hole 24 is made through in the upper part of every lateral supporting wall 16 and can also be used to allow the positioning of pressure and/or inspection members, of a known type, which allow the piece to be pressed and/or the work done in the work zone Z and the transport zone T to be controlled.

The through aperture 25, on the contrary, has a shaping such as to allow to insert inside every module 12 any feed member 20, 120, 220, 320 or 420. In the case shown in FIGS. 2, 3 and 4, the feed member indicated by the number 220 is inserted. In this case it is not necessary to provide, on each occasion, specific connection elements, and there is no risk of the structure of each lateral supporting wall 16 becoming excessively weakened. To be more exact, the through aperture 25 has a lower zone 25*a* able, for example, to allow the insertion of the various motors of the feed members 20, 120, 220, 320, 420, whatever their shape or size may be, an intermediate zone 25*b* able to allow the insertion of the supports for the feed members 20, 120, 220, 320, 420, and an upper zone 25*c* able to allow the housing of the various belts or rollers that determine the guide and advance of the profiled element 11.

Figures 5, 6, 9:
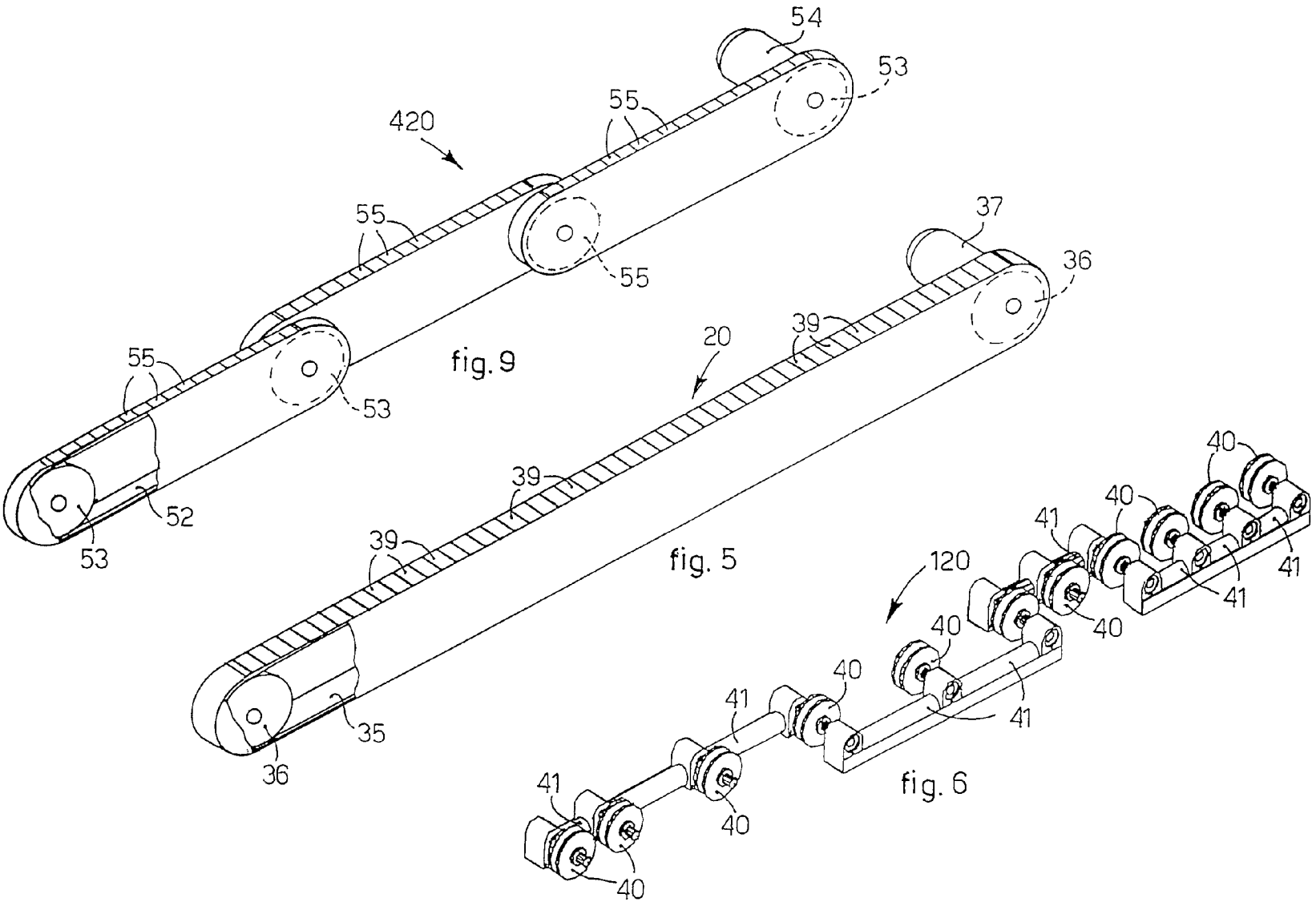
FIG. 5 is a schematic view of a first type of feed means able to be associated with the machine in FIG. 1.
FIG. 6 is a schematic view of a second type of feed means able to be associated with the machine in FIG. 1.
FIG. 9 is a schematic view of a fifth type of feed means able to be associated with the machine in FIG. 1.

In the embodiment shown in FIG. 5, the feed member 20 consists of a track 35, arranged annularly around two pulleys 36, of which one is motorized by means of an electric motor 37, and provided on the outside with a plurality of pads 39 able to contact the lower surface of the profiled element 11 in order to make it advance through the modules 12, along the reference plane P1.

In the embodiment shown in FIG. 6, the feed member 120 comprises a plurality of rollers 40, connected to each other and moved by means of a plurality of transmission members 41, in turn connected kinematically with a motor member, not shown here. In this embodiment the profiled element 11 is positioned above the rollers 40, so that the rotation of the latter determines its advance through the modules 12, along the reference plane P1.

Figures 7, 8:
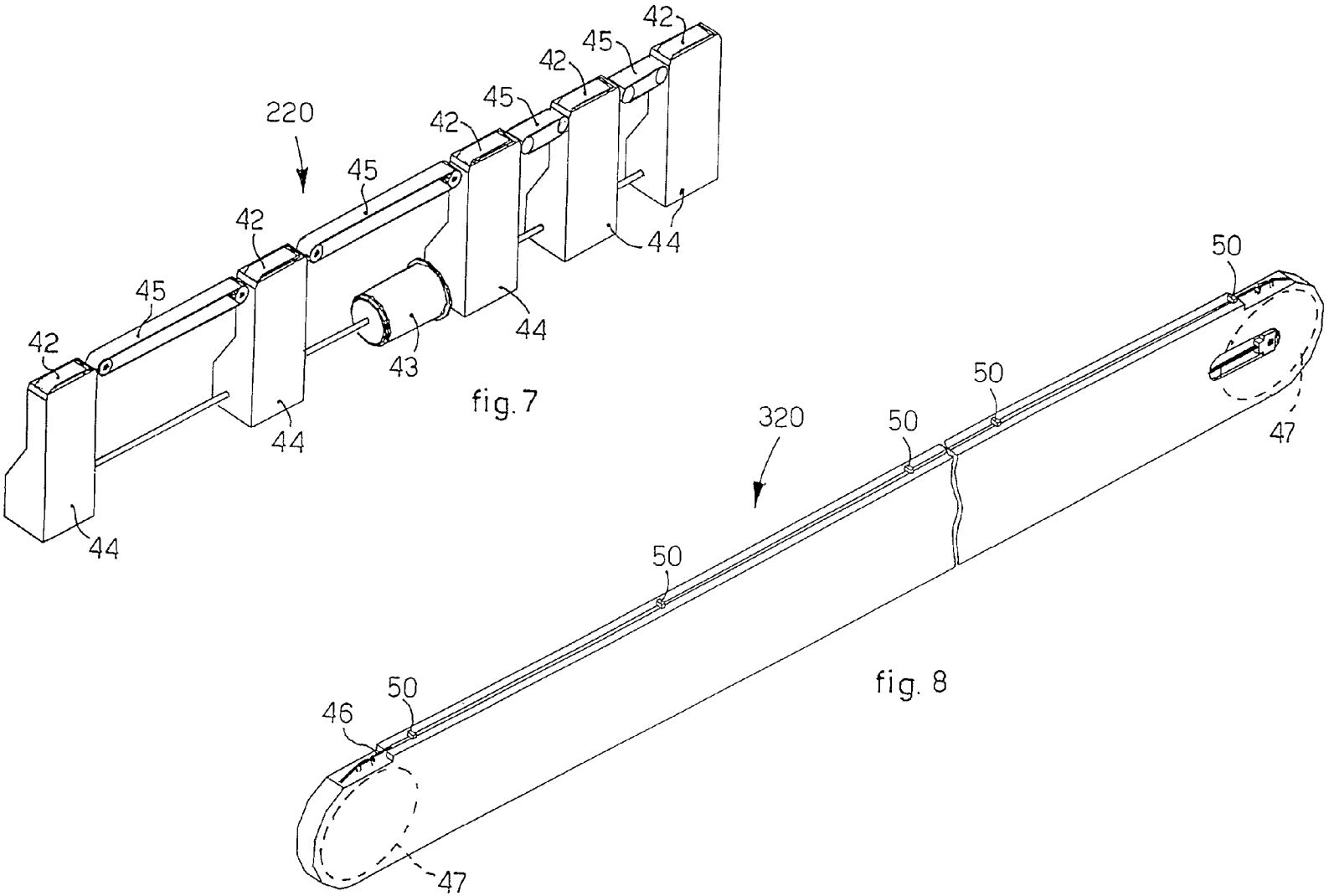
FIG. 7 is a schematic view of a third type of feed means able to be associated with the machine in FIG. 1.
FIG. 8 is a schematic view of a fourth type of feed means able be associated with the machine in FIG. 1.

FIG. 7 shows a third type of feed member 220, in this case comprising five conveyor belts 42, motorized in a known manner by means of a single motor member 43, arranged in correspondence with the various transport zones T and supported by relative supports 44 arranged in correspondence with the intermediate zone 25*b* of the through aperture 25. In alternation with the conveyor belts 42 four conveyor belts 45 are arranged. The latter are positioned in correspondence with the work zones Z of every module 12. According to a variant of this embodiment, the conveyor belts 42 and 45 can be arranged offset with respect to each other.

In the embodiment shown in FIG. 8, the feed member 320 comprises a chain 46 wound around two crowns 47, of which one is motorized by means of a motor member of a substantially known type, and provided on the outside at regular intervals with a plurality of blocks 50 able to thrust the profiled element 11 from the rear along the reference plane P1.

In the embodiment shown in FIG. 9, the feed member 420 consists of three tracks 52, substantially half the thickness with respect to the track 35 of the feed member 20, arranged in succession and at least partly superimposed in correspondence with the segments wherein they are wound on the respective pulleys 53. At least one of the pulleys 53 is motorized by means of an electric motor 54, and every track 52 is provided on the outside with a plurality of pads 55 able to contact the lower surface of the profiled element 11 in order to feed it through the modules 12, along the reference plane P1.

According to a variant, every track 52 can be replaced by a belt, or any other similar or comparable transport element.

It is clear, however, that modifications and/or additions of parts may be made to the machine 10 as described heretofore, without departing from the field and scope of the present invention.

It is also clear that, although the present invention has been described with reference to specific examples, a person of skill in the art shall certainly be able to achieve many other equivalent forms of machine for finishing an object such as a profiled element, a panel or suchlike, having the characteristics as set forth in the claims and hence all coming within the field of protection defined thereby.

The invention claimed is:

1. A machine for finishing an object comprising feed means to feed said object along a reference plane (P1), and at least a work station provided with at least a tool which is able to contact said object in a work zone (Z) near said reference plane (P1), wherein said work station is able to be positioned in a plurality of work positions including a first position in which said work station lies substantially on a median plane (P2), and a second position in which said work station is substantially inclined by an angle of less than 180° with respect to said first position so that said plurality of work positions defines a circular work sector (S), and wherein a protection element is able to at least temporarily cover said work zone (Z) and is arranged on a side opposite of said circular work sector (S) with respect to said median plane (P2), the machine also comprising two lateral supporting walls arranged substantially orthogonal both to said reference plane (P1) and also to a median plane (P2), substantially perpendicular to said reference plane (P1), and able to support said work station laterally, in order to define with said work station a modular structure able to be selectively associated with other modular structures along the direction of feed of said object, wherein each of said two lateral supporting walls comprises a through aperture disposed aligned with said reference plane (P1), facing and coaxial with a similar through aperture made on the other lateral supporting wall, and wherein feed means are positioned inside said through apertures to feed said object through any modular structure along said reference plane (P1).

2. A machine as in claim 1, wherein said protection element extends laterally in order to cover at least a transit zone (T) adjacent to said work zone (Z).

3. A machine as in claim 2 wherein said protection element is able to be positioned with respect to said lateral supporting walls between a protection position in which said protection element prevents access to said work zone (Z) or to said transit zone (T), and an equipping position in which said protection element allows access to said work zone (Z) or to said transit zone (T).

4. A machine as in claim 1, wherein each of said two lateral supporting walls has an eyelet, able to allow the positioning of a pressure member able to guide and keep said object in a desired reference position during the finishing of said object.

5. A machine as in claim 1, wherein each of said two lateral supporting walls has a plurality of positioning holes, able to allow the positioning of lateral or directable guide members able to keep said object in a desired reference position during the finishing of said object.

6. A machine as in claim 1, wherein said feed means comprise a track, arranged annularly around two pulleys, of which one is motorized by means of a motor member, and provided on the outside with a plurality of pads able to contact a lower surface of said object in order to make said object advance along said reference plane (P1).

7. A machine as in claim 1, wherein said feed means comprises a plurality of rollers, connected to each other and moved by means of a plurality of transmission members, in turn connected kinematically with a common motor member, and able to contact a lower surface of said object in order to make said object advance along said reference plane (P1).

8. A machine as in claim 1, wherein said feed means comprise a plurality of first motorized conveyor belts, arranged in alternation with a plurality of second idle conveyor belts, said first conveyor belts and said second conveyor belts being able to contact a lower surface of said object in order to make said object advance along said reference plane (P1).

9. A machine as in claim 1, wherein said feed means comprise a housing in which a chain wound around a plurality of crowns, of which one is motorized by means of a motor member, and a plurality of blocks provided outside of said housing at regular intervals to thrust said object from one lateral supporting wall to the other lateral supporting wall in order to make said object advance along said reference plane (P1).

10. A machine as in claim 1, wherein said feed means comprise a plurality of tracks wound annularly on respective pulleys and arranged in succession and at least partly superimposed in correspondence with the segments wherein they are wound on said pulleys, at least one of said pulleys being motorized by means of a motor member.

11. A machine as in claim 10, wherein each of said tracks is provided on the outside of the housing with a plurality of pads able to contact the lower surface of said object in order to make said object advance along said reference plane (P1).

12. A machine as in claim 1, wherein said work station comprises a belt-type smoothing machine provided with at least an abrasive belt wound around a plurality of pulleys so that at least one segment thereof is substantially tensed and rectilinear, to be arranged in contact with said object in said work zone.

13. A machine for finishing an object comprising feed means to feed said object along a reference plane (P1), and at least a work station provided with at least a tool which is able to contact said object in a work zone (Z) near said reference plane (P1), wherein said work station is able to be positioned in a plurality of work positions including a first position in which said work station lies substantially on a median plane (P2), and a second position in which said work station is substantially inclined by an angle of less than 180° with respect to said first position so that said plurality of work positions defines a circular work sector (S), and wherein a protection element is able to at least temporarily cover said work zone (Z) and is arranged on a side opposite of said circular work sector (S) with respect to said median plane (P2), the machine also comprising two lateral supporting walls arranged substantially orthogonal both to said reference plane (P1) and also to said median plane (P2) that is substantially perpendicular to said reference plane (P1) and able to support said work station laterally in order to define with said work station a modular structure able to be selectively associated with other modular structures along the direction of feed of said object, said protection element is able to be positioned with respect to said lateral supporting walls between a protection position in which said protection element prevents access to said work zone (Z) or to a transit zone (T), and an equipping position in which said protection element allows access to said work zone (Z) or to said transit zone (T), wherein each of said two lateral supporting walls comprises a through aperture disposed aligned with said reference plane (P1), facing and coaxial with a similar through aperture made on the other lateral supporting wall, wherein each of said two lateral supporting walls comprises a sliding guide facing towards said work station and inside which respective sliding means of said protection element are able to slide in order to allow said protection element to be positioned between said protection position and said equipping position, and wherein feed means are positioned inside said through apertures to feed said object through any modular structure along said reference plane (P1).

14. A machine as in claim 13, wherein said sliding means comprise a pair of rotatable sliding wheels mounted laterally to said protection element and able to slide inside said sliding guides, and wherein said protection element includes, on the outer side, a gripping member connected to at least a bar that is pivoted with respect to the inner side of said protection element, to a guide lever, which is in turn pivoted on the lateral supporting walls.

15. A machine as in claim 13, wherein said protection element comprises a plurality of sections pivoted to each other and able to slide inside said sliding guides.

16. A machine as in claim 13, wherein said protection element comprises at least a door pivoted to at least one of said two lateral supporting walls.

* * * * *